US009695026B2

(12) United States Patent
Simmons

(10) Patent No.: US 9,695,026 B2
(45) Date of Patent: Jul. 4, 2017

(54) BOTTLE CAP REMOVER WITH CAP RETAINING MAGNET

(71) Applicant: David Odell Simmons, Austin, TX (US)

(72) Inventor: David Odell Simmons, Austin, TX (US)

(73) Assignee: Getagadget LLC, Austin, TX (US)

( * ) Notice: Subject to any disclaimer, the term of this patent is extended or adjusted under 35 U.S.C. 154(b) by 303 days.

(21) Appl. No.: 14/251,585

(22) Filed: Apr. 12, 2014

(65) Prior Publication Data

US 2014/0318321 A1 Oct. 30, 2014

Related U.S. Application Data

(60) Provisional application No. 61/817,638, filed on Apr. 30, 2013.

(51) Int. Cl.
*B67B 7/16* (2006.01)

(52) U.S. Cl.
CPC ..... *B67B 7/16* (2013.01)

(58) Field of Classification Search
CPC .... B67B 7/12; B67B 7/16; B67B 7/44; B67B 2007/168
See application file for complete search history.

(56) References Cited

U.S. PATENT DOCUMENTS 2,116,306 A 5/1938 Dziembowski
2,330,893 A 10/1943 Hutaff et al.
2,510,459 A * 6/1950 Bloomfield ..... B67B 3/02 53/341
2,514,565 A 7/1950 Caproccio
2,514,566 A 7/1950 Caproccio
2,542,329 A * 2/1951 Hammond, Jr. ..... B67B 7/16 294/65.5
2,593,053 A * 4/1952 Porter, Jr. ..... B67B 7/16 7/901
2,625,847 A 1/1953 Frazier
2,674,909 A * 4/1954 Morris ..... B67B 7/16 7/901
2,728,250 A 12/1955 Robert
2,762,246 A * 9/1956 Gundelfinger ..... B67B 7/16 7/901
2,774,264 A * 12/1956 Bryant ..... B67B 7/16 7/152
3,730,026 A 5/1973 Matsumoto
4,433,597 A 2/1984 Rowland
4,455,894 A 6/1984 Roberts
(Continued)

*Primary Examiner* — David B Thomas
(74) *Attorney, Agent, or Firm* — David O. Simmons

(57) ABSTRACT

A bottle cap remover includes a main body having an access opening therein, a bottle cap prying structure fixedly secured to the main body, and a magnet secured to at least one of the bottle cap prying structure and the main body. The bottle cap prying structure has a bottle cap receiving opening therein with opposing edge portions. The bottle cap receiving opening is exposed within the access opening of the main body. A bottle cap edge engaging portion of the bottle cap prying structure is defined by a first one of the opposing edge portions of the bottle cap receiving opening. The magnet is positioned adjacent to a second one of the opposing edge portions of the bottle cap receiving opening.

4 Claims, 1 Drawing Sheet

(56) References Cited

U.S. PATENT DOCUMENTS

| | | | | |
|---|---|---|---|---|
| 4,846,024 | A * | 7/1989 | Bryant | B67B 7/44 81/3.09 |
| 4,967,622 | A | 11/1990 | Phillips | |
| 4,979,407 | A | 12/1990 | Hernandez et al. | |
| 6,098,497 | A | 8/2000 | Larose | |
| 6,105,468 | A | 8/2000 | Fohrman et al. | |
| 6,957,599 | B2 | 10/2005 | Corredor et al. | |
| 7,409,892 | B2 * | 8/2008 | Monk | B67B 7/16 81/3.08 |
| 7,685,908 | B1 * | 3/2010 | Sebastian | A47G 23/0216 81/3.09 |
| 8,245,600 | B2 * | 8/2012 | Beard | A47G 23/0241 81/3.09 |
| 9,120,659 | B2 * | 9/2015 | Bailey | B67B 7/18 81/3.09 |
| 2008/0173135 | A1 * | 7/2008 | Beard | B67B 7/16 81/3.09 |
| 2010/0288080 | A1 * | 11/2010 | Babusiaux | B67B 7/16 81/3.4 |
| 2011/0041655 | A1 * | 2/2011 | Muniz | B67B 7/16 81/3.08 |
| 2014/0238199 | A1 * | 8/2014 | Bailey | B67B 7/16 81/3.09 |
| 2014/0263336 | A1 * | 9/2014 | Hicks | A47G 19/22 220/284 |

* cited by examiner

BOTTLE CAP REMOVER WITH CAP RETAINING MAGNET

CROSS REFERENCE TO RELATED APPLICATIONS

This patent application claims priority from U.S. Provisional Patent Application Ser. No. 61/817,638, filed 30 Apr. 2013, entitled "BOTTLE CAP REMOVER WITH CAP RETAINING MAGNET", having a common applicant herewith and being incorporated herein in its entirety by reference.

FIELD OF THE DISCLOSURE

The disclosures made herein relate generally to bottle cap removers and, more particularly, to bottle cap removers for crimped on bottle caps.

BACKGROUND

Crimped-on bottle caps are very well known. A bottle has a circular-shaped opening with a circumferential lip. The circumferential lip is generally has a round cross-sectional shape. To seal closed an interior space of the bottle, a bottle cap is crimped onto the bottle over the circular-shaped opening. Edge portions of the bottle cap become engaged with the circumferential lip of the circular-shaped opening. The bottle cap, which is typically made from steel, has a sealing member on its interior surface that becomes engaged with an upper edge portion of the circular-shaped opening for enabling a gas and liquid resistant seal to be created between the bottle cap and the bottle as a result of the bottle cap being crimped onto the bottle over the circular-shaped opening.

It is also very well known that a hand-held and operated bottle cap remover has been the long-standing device for removing a crimped-on bottle cap from a bottle. Examples of hand-held and operated bottle cap removers are disclosed in U.S. Pat. Nos. 6,957,599; 4,979,407; 4,967,622; 2,625,847; 2,514,566, and 2,330,893. The common structure of these disclosed bottle cap remover is a bottle cap receiving opening that has a cap edge engaging portion for being engaged under a lower edge of the bottle cap and a distally located bottle cap bearing surface or edge(s) that engage an upper surface/edge portion of the bottle cap. Through a lever pivoting action of the bottle cap remover, the bottle cap is pried off of the upper edge portion of the circular-shaped opening.

When using a hand-held and operated bottle cap remover to remove a bottle cap, a common situation that occurs is that bottle cap falls from the bottle cap remover after it has been pried off of the bottle. This can lead to unnecessary litter or simply the inconvenience of having to retrieve the fallen bottle cap. Therefore, a hand-held and operated bottle cap remover that uses a magnet to hold a bottle cap in contact with the bottle cap remover after it has been pried off of the bottle would be advantageous, desirable and useful.

SUMMARY OF THE DISCLOSURE

Embodiments of the present invention relate to a hand-held and operated bottle cap remover that is configured to hold a bottle cap in contact with the bottle cap remover after it has been pried off of the bottle. More specifically, bottle cap removers configured in accordance with the present invention have an integral magnet that is located and configured for to hold a bottle cap in contact with the bottle cap remover after it has been pried off of the bottle. Advantageously, this precludes the bottle cap from unintentionally detaching from the bottle cap remover and falling to a location where it must be retrieved to preclude it from becomes litter.

In one embodiment of the present invention, a bottle cap remover comprises a main body, a bottle cap prying structure fixedly secured to the main body, and a magnet secured to at least one of the bottle cap prying structure and the main body. The bottle cap prying structure has a bottle cap receiving opening therein with opposing edge portions. A bottle cap edge engaging portion of the bottle cap prying structure is defined by a first one of the opposing edge portions of the bottle cap receiving opening. The magnet is positioned one of adjacent to a second one of the opposing edge portions of the bottle cap receiving opening and adjacent an transverse edge portion extending between the opposing edge portions.

In another embodiment of the present invention, a bottle cap remover comprises a main body having an access opening therein, a bottle cap prying structure fixedly secured to the main body, and a magnet secured to at least one of the bottle cap prying structure and the main body. The bottle cap prying structure has a bottle cap receiving opening therein with opposing edge portions. The bottle cap receiving opening is exposed within the access opening of the main body. A bottle cap edge engaging portion of the bottle cap prying structure is defined by a first one of the opposing edge portions of the bottle cap receiving opening. The magnet is positioned adjacent to a second one of the opposing edge portions of the bottle cap receiving opening.

In another embodiment of the present invention, a bottle cap remover comprises a bottle cap prying structure, a main body, and a magnet. The bottle cap prying structure has a bottle cap receiving opening therein. The main body is formed over edge portions of the bottle cap prying structure for securing the bottle cap prying structure in a fixed relationship with respect to the main body. A bottle cap edge engaging portion of the bottle cap prying structure is defined by a first edge portion of the bottle cap receiving opening. A bottle cap bearing portion of the bottle cap prying structure is defined by a second edge portion of the bottle cap receiving opening. A region of the bottle cap prying structure surrounding the bottle cap receiving opening is exposed within an opening in a first side of the main body for enabling access to the bottle cap prying structure. The main body includes a magnet receiving receptacle adjacent to the bottle cap bearing portion of the bottle cap prying structure. The magnet is positioned within the magnet receiving receptacle of the main body.

These and other objects, embodiments, advantages and/or distinctions of the present invention will become readily apparent upon further review of the following specification, associated drawings and appended claims.

DETAILED DESCRIPTION

Figure 1:
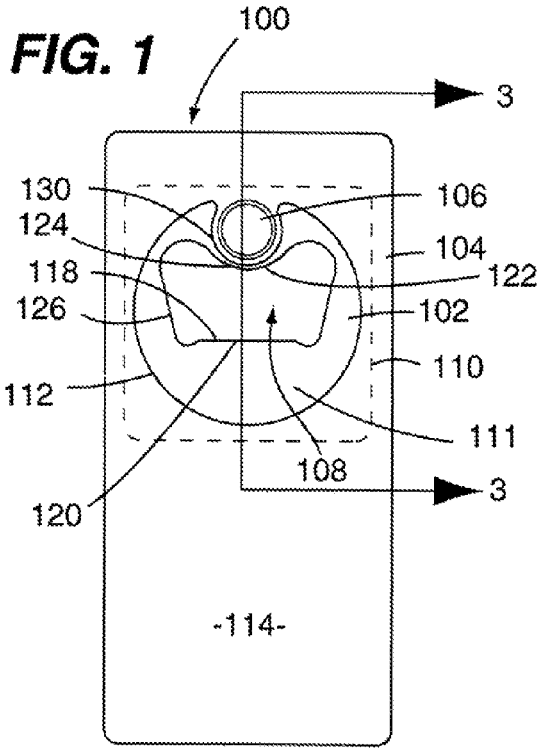
FIG. 1 is a plan view showing a first side of a bottle cap remover configured in accordance with an embodiment of the present invention.
Figure 2:
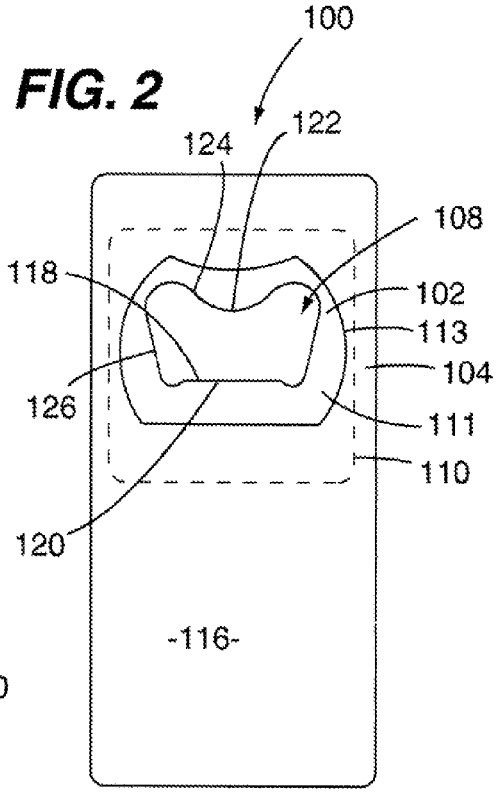
FIG. 2 is a plan view showing a second side of the bottle cap remover shown in FIG. 1.
Figure 3:
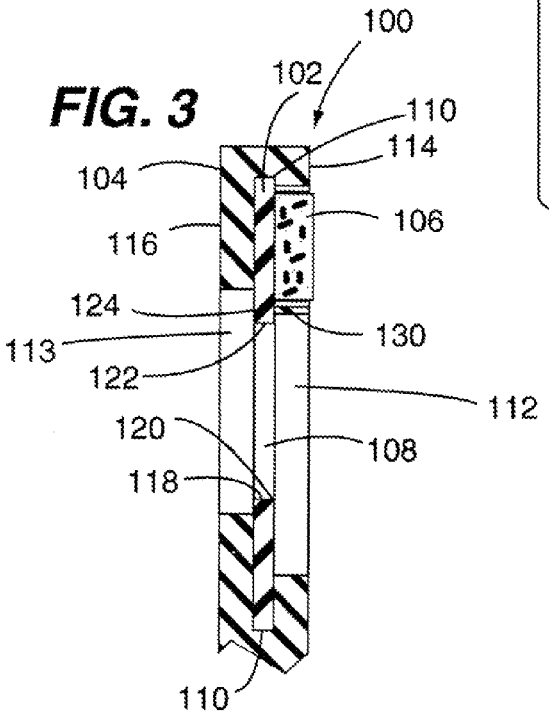
FIG. 3 is a cross-sectional view taken along the line 3-3 in FIG. 1.

FIGS. 1-3 show a bottle cap remover 100 configured in accordance with an embodiment of the present invention.

The bottle cap remover 100 includes a bottle cap prying structure 102, a main body 104, and a magnet 106. The bottle cap prying structure 102 has a bottle cap receiving opening 108 therein. The main body 104 is formed over edge portions 110 of the bottle cap prying structure 102 for securing the bottle cap prying structure 102 in a fixed relationship with respect to the main body 104.

As shown in FIGS. 1 and 3, a region of the bottle cap prying structure 102 surrounding the bottle cap receiving opening 108 (i.e., central portion 111) is exposed within an access opening 112 in a first side 114 of the main body 104 for enabling access to the bottle cap prying structure 102. Optionally, as shown in FIGS. 2 and 3, the central region 2111 of the bottle cap prying structure 102 is exposed within an access opening 113 in a second side 116 of the main body 104 for enabling access to the bottle cap prying structure 102. It is disclosed herein that a cover can be secured to a second side 116 of the main body 104 over the opening 112 for providing the main body 104 with a three-dimensional shape (e.g., a cover that adds vertical contour complementing a shape of the main body 104). Preferably, but not necessarily, the region of the bottle cap prying structure 102 that is exposed within the access opening 112 in the first side 114 of the main body 102 is substantially flat (e.g., a piece of steel that is cut by means such as stamping, laser cutting and/or water jet cutting).

Embodiments of the present invention are not unnecessarily limited to a particular means of joining the bottle cap prying structure 102 and the main body 104. As shown, the bottle cap prying structure 102 is a piece of metal and the main body 104 is made of polymeric material. The main body 104 can be formed over the bottle cap prying structure 102 using a technique such as molding. Alternatively, the main body 104 can include a front shell and rear shell that jointly define an interior space for receiving the bottle cap prying structure 102 and that are adjoinable with each other (e.g., mechanically, thermally, chemically, etc) for capturing the bottle cap prying structure 102 within the interior space. Additionally, it is disclosed herein that the bottle cap prying structure 102 and the main body 104 can be a one-piece unitarily formed structure (e.g., a one-piece injection molded structure).

A bottle cap edge engaging portion 118 of the bottle cap prying structure 102 is defined by a first edge portion 120 of the bottle cap receiving opening 108. A bottle cap bearing portion 122 of the bottle cap prying structure 102 is defined by a second edge portion 124 of the bottle cap receiving opening 108. Alternatively, a bottle cap bearing portion of the bottle cap prying structure 102 can be defined by transverse edge portions 126 of the bottle cap receiving opening 108 that extend between the opposing edge portions first and second edge portion 120, 124 (i.e., opposing edge portions) of the bottle cap receiving opening 108.

The main body 104 includes a magnet receiving receptacle 130 adjacent to the bottle cap bearing portion 122 of the bottle cap prying structure 102. The magnet 106 is positioned within the magnet receiving receptacle 130 of the main body 104. Preferably, but not necessarily, the magnet receiving receptacle 130 encircles an entire circumference of the magnet 106. The magnet receiving receptacle 130 can have an open or closed bottom end. In the case of an open bottom end, the magnet can be in direct contact with the bottle cap prying structure 102 (e.g., providing dimensions of the magnet 106 and the magnet receiving receptacle 130 allow for this). In the case of the closed bottom end (or a bottom end with a landing), the magnet 106 will be seated on a face of the closed bottom end.

Preferably, but not necessarily, the magnet 106 is secured in place through magnetic attractive force even in the case where the magnet receiving receptacle 130 has a closed bottom end. Alternatively, the magnet 106 can be secured in place via an adhesive and/or mechanical fastening means (e.g., a rivet extending through corresponding holes in the bottle cap prying structure 102 and the magnet 106). In the embodiment disclosed above, where the main body 104 includes a front shell and rear shell that are adjoinable with each other, the magnet 106 can be located within a cavity in one of the shells (e.g., open end of the cavity is covered by the bottle cap prying structure 102) or the magnet 106 can be located within opposing cavities of each one of the shells (e.g., the bottle cap prying structure 102 has a magnet receiving passage therein for allowing the magnet to reside within the magnet receiving passage and be captured within opposing cavities of the shells).

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A bottle cap remover, comprising:

a bottle cap prying structure having a bottle cap receiving opening therein with opposing edge portions, wherein the bottle cap prying structure is a piece of steel, wherein a bottle cap edge engaging portion of the bottle cap prying structure is defined by a first one of the opposing edge portions of the bottle cap receiving opening, wherein a bottle cap bearing portion of the bottle cap prying structure is defined by a second one of the opposing edge portions of the bottle cap receiving opening, and wherein the bottle cap bearing portion is curved such that a central portion thereof protrudes toward the first one of the opposing edge portions of the bottle cap receiving opening;

a main body fixedly attached to the bottle cap prying structure, wherein the main body is made of polymeric material and is formed over edge portions of the bottle cap prying structure for securing the bottle cap prying structure in a fixed relationship with respect to the main body, wherein the main body includes a magnet receiving receptacle that extends over said protruding central portion of the bottle cap bearing portion, wherein the magnet receiving receptacle has an open bottom end and wherein a portion of the bottle cap prying structure extends at least partially across the open bottom end of the magnet receiving receptacle such that a top surface of the bottle cap prying structure is exposed within the magnet receiving receptacle; and a magnet positioned within the magnet receiving receptacle, wherein the magnet and the magnet receiving receptacle are jointly configured such that at least a portion of the magnet is positioned over said protruding central portion of the bottle cap bearing portion, and wherein the magnet abuts the top surface of the bottle cap prying structure such that the magnet is retained within the magnet receiving receptacle in contact with the top surface of the bottle cap prying structure through magnetic attractive force that engages the magnet with the top surface of the bottle cap prying structure.

2. A bottle cap remover, comprising:

a main body having an access opening therein, wherein the main body is made of polymeric material and is formed over edge portions of the bottle cap prying structure for securing the bottle cap prying structure in a fixed relationship with respect to the main body and wherein the main body includes a magnet receiving receptacle at a position along the second one of the opposing edge portions of the bottle cap receiving opening;

a bottle cap prying structure fixedly secured to the main body, wherein the bottle cap prying structure is a piece of steel, wherein the bottle cap prying structure has a bottle cap receiving opening therein with opposing edge portions, wherein the bottle cap receiving opening is exposed within the access opening of the main body, wherein a bottle cap edge engaging portion of the bottle cap prying structure is defined by a first one of the opposing edge portions of the bottle cap receiving opening, wherein a bottle cap bearing portion of the bottle cap prying structure is defined by a second one of the opposing edge portions of the bottle cap receiving opening, and wherein the bottle cap bearing portion is curved such that a central portion thereof protrudes toward the first one of the opposing edge portions of the bottle cap receiving opening; and a magnet positioned within the magnet receiving receptacle of the main body, wherein at least a portion of the magnet is positioned over said protruding central portion of the bottle cap bearing portion and wherein the magnet is positioned above the bottle cap prying structure such that the magnet is retained within the magnet receiving receptacle through magnetic attractive force.

3. A bottle cap remover, comprising:

a bottle cap prying structure having a bottle cap receiving opening therein, wherein the bottle cap prying structure is made from a piece of steel, wherein a bottle cap edge engaging portion of the bottle cap prying structure is defined by a first edge portion of the bottle cap receiving opening, wherein a bottle cap bearing portion of the bottle cap prying structure is defined by a second edge portion of the bottle cap receiving opening, and wherein the bottle cap bearing portion is curved such that a central portion thereof protrudes toward the first one of the opposing edge portions of the bottle cap receiving opening;

a main body formed over a top surface, a bottom surface and edge portions of the bottle cap prying structure for securing the bottle cap prying structure in a fixed relationship with respect to the main body, wherein the main body is made of polymeric material, wherein a region of the bottle cap prying structure surrounding the bottle cap receiving opening is exposed within an opening in a first side of the main body for enabling access to the bottle cap prying structure, wherein the main body includes a magnet receiving receptacle adjacent to the bottle cap bearing portion of the bottle cap prying structure; and a magnet positioned within the magnet receiving receptacle of the main body, wherein at least a portion of the magnet receiving receptacle is positioned over said protruding central portion of the bottle cap bearing portion, wherein the magnet abuts the top surface of the bottle cap prying structure such that the magnet is retained within the magnet receiving receptacle in contact with the top surface of the bottle cap prying structure through magnetic attractive force that engages the magnet with the top surface of the bottle cap prying structure and wherein magnet receiving receptacle encircles an entire circumference of the magnet.

4. The bottle cap remover of claim 3 wherein the region of the bottle cap prying structure that is exposed within the opening in the first side of the main body is substantially flat.

* * * * *